United States Patent [19]

Reiber et al.

[11] Patent Number: 4,671,421

[45] Date of Patent: Jun. 9, 1987

[54] PLASTIC CONTAINER

[75] Inventors: Thomas L. Reiber, Wyoming; Gerald R. Robinson, Perrysburg, both of Ohio

[73] Assignee: Owens-Illinois, Inc., Toledo, Ohio

[21] Appl. No.: 836,875

[22] Filed: Mar. 6, 1986

[51] Int. Cl.[4] ..... B65D 41/04

[52] U.S. Cl. ..... 215/228; 215/31; 215/335

[58] Field of Search ..... 215/31, 335, 228

[56] References Cited

U.S. PATENT DOCUMENTS

| | | | |
|---|---|---|---|
| 2,448,569 | 9/1948 | Allen | 215/335 X |
| 3,899,096 | 8/1975 | Marco | 215/335 X |
| 4,341,317 | 7/1982 | Suzuki et al. | 215/31 |

*Primary Examiner*—Donald F. Norton

*Attorney, Agent, or Firm*—Philip M. Rice

[57] ABSTRACT

A plastic container which comprises a plastic blow molded container having an annular finish, an insert positioned in the finish and interengaged with the internal surface of the finish. The insert has internal threads for receiving an enlarged closure such in the form of a self-draining measuring cup having external threads on the lower end thereof and a peripheral flange sealingly engaging the free end of the finish.

21 Claims, 5 Drawing Figures

PLASTIC CONTAINER

This invention relates to plastic containers and in particularly to plastic packages for liquids and the like.

BACKGROUND AND SUMMARY OF THE INVENTION

In the manufacture of plastic containers and packages utilizing such plastic containers, it has become desirable in one form of package to have internal threads on the inner surface of the finish for engaging external threads on a closure in the shape of a measuring cup. Such internal threads are difficult to form and control accurately to produce a proper seal.

Accordingly, among the objectives of the present invention are to provide a plastic container having internal threads which can be manufactured at lower cost and more easily, which will provide the desired dimensional control of the threads, and which can be adapted to use a closure that cooperates with the finish to provide a proper seal, and which can also be adapted to the utilization of a circumferentially oriented pour spout.

In accordance with the invention, the plastic container comprises a plastic blow molded container having an annular finish, an insert positioned in the finish and interengaged with the internal surface of the finish. The insert has internal threads for receiving a closure such as an enlarged closure in the form of a self-draining measuring cup having external threads on the lower end thereof and a peripheral flange sealingly engaging the free end of the finish.

DESCRIPTION

Figure 1:
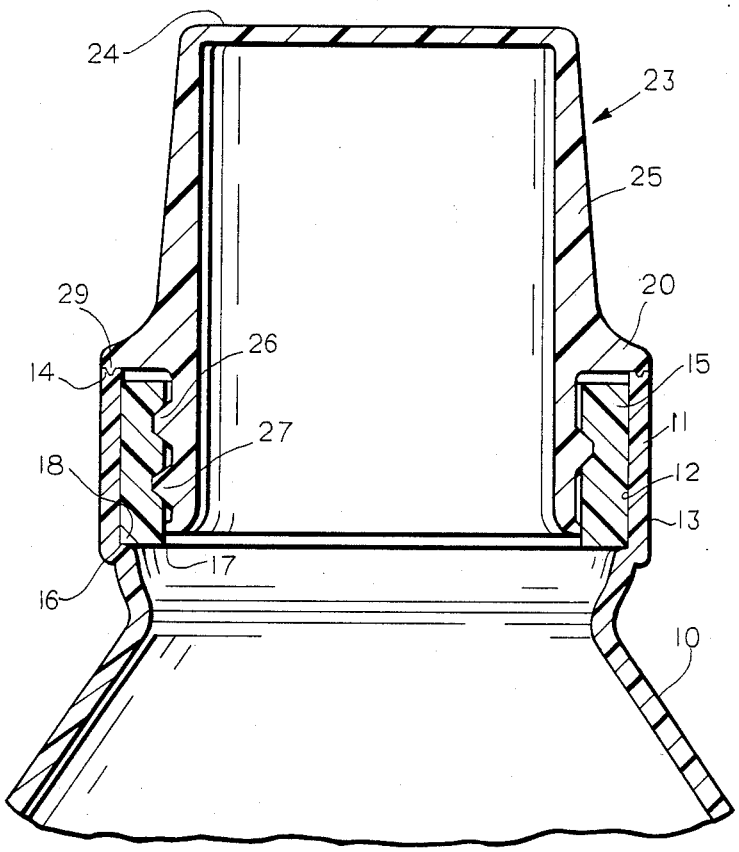
FIG. 1 is a longitudinal sectional view of a portion of the container embodying the invention.

Referring to FIG. 1, the plastic container embodying the invention comprises a hollow blow molded container 10 having a finish 11 which is generally cylindrical and has an inner surface 12 and an outer surface 13. After the container is blown, the end surface 14 of the finish is machined to provide a flat sealing plane. The container further includes an annular insert 15 which engages the inner surface 12 to interconnect the insert 15 with the finish 11.

The blow molded container and insert may be made of thermoplastic materials such as high density polyethylene, low density polyethylene, polypropylene, and polyvinyl chloride.

The insert 15 preferably has a lower surface 17 with a lower edge that engages a complementary surface 18 formed by an annular portion 16 having lesser diameter than the finish 11.

In one form, the insert is placed in position while the finish 11 is hot and when the finish cools, it will shrink into sealing engagement with the insert.

In another form, the insert 12 is spin welded into sealing engagement with the finish 11. Alternatively, an adhesive may be used.

Figure 3:
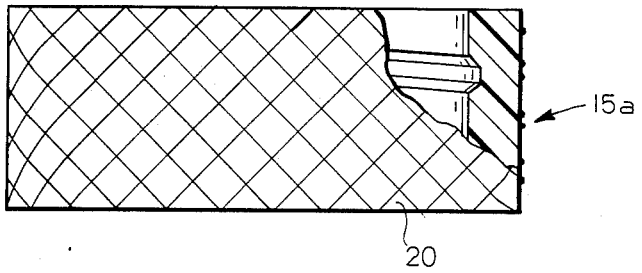
FIG. 3 is a part sectional view of a modified form of insert.
Figure 4:
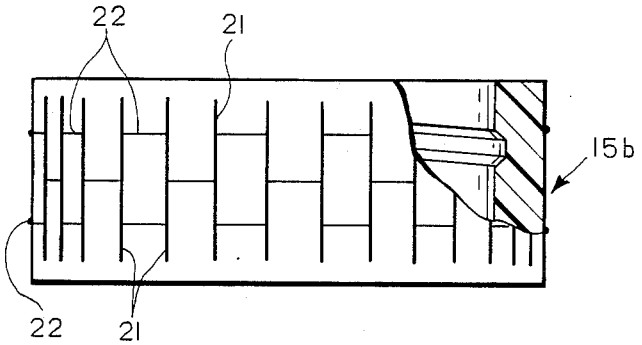
FIG. 4 is a part sectional view of another modified form of insert.

The surfaces between the insert **15*b* and the neck 11 include raised knurling 20 as shown in FIG. 3, or the insert 15*b* may have vertical or horizontal raised splines 21, 22 as shown in FIG. 4** to prevent relative rotation between the insert and the finish or axial movement when a torque is applied to the insert by the closure, as presently described.

Further, in accordance with the invention, a closure 23 is provided having a base wall 24 and a peripheral wall 25 the lower end of which is formed with external threads 26 engaging internal threads 27 on the insert.

In addition, the closure 23 includes an annular wall or flange 28 spaced from the lower free edge of the wall 25 and extending radially outwardly in overlying relation to the end surface 14 of the finish 11. Flange 28 includes a downwardly extending projection 29 which engages the surface 14 to seal against the finish 11. The cross section of the projection 29 is preferably in the form of V.

The wall 25 extends upwardly above the neck so that the closure can serve the function of a measuring cup.

Figure 2:
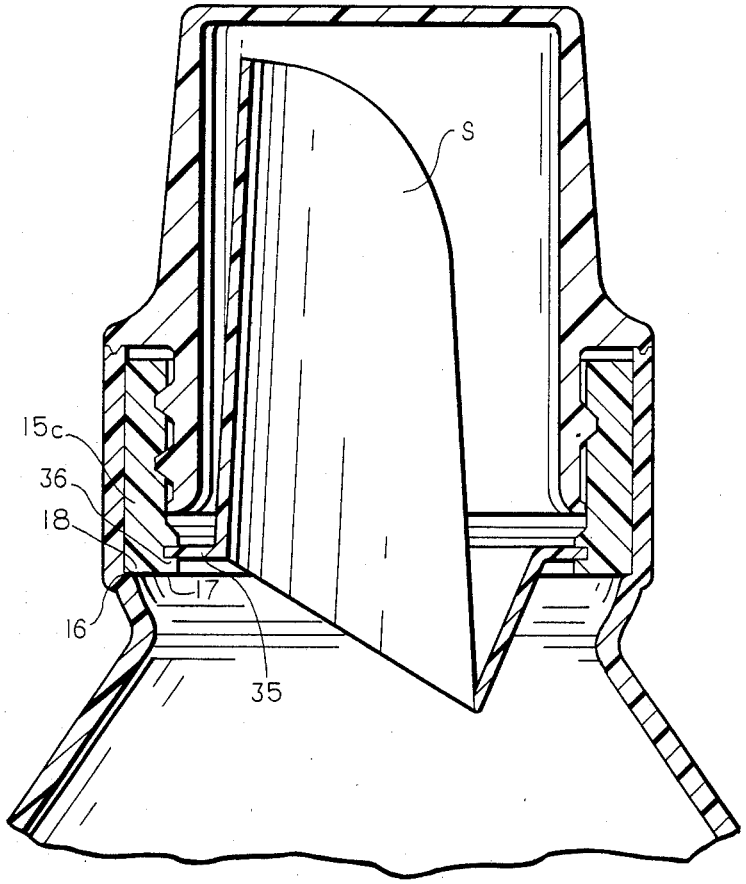
FIG. 2 is a longitudinal sectional view of a modified form of the invention.

In the form shown in FIG. 2, a spout S in the form of an axially extending portion 35 having a U-cross section is supported in insert 15 by engagement of a flange 35 thereon in a groove 36 of insert **15*c*. When the closure 23** is removed for use in measuring and is gain applied to the container, any liquid remaining in the cup drains back into the container.

Figure 5:
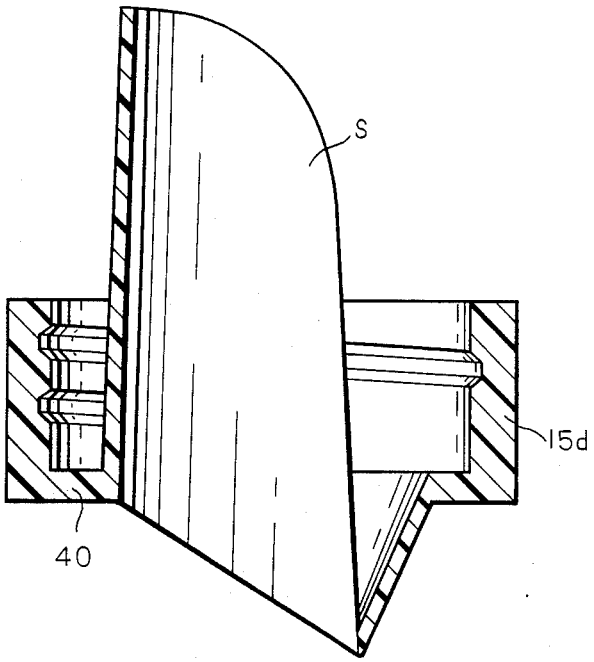
FIG. 5 is a sectional view of a further modified form of insert.

In the form shown in FIG. 5, the insert **15*d* has the spout S′ formed integrally thereon by a connecting portion 40**.

In each of the forms, the insert 15 is positioned axially of the finish so that the upper end of the insert is spaced from the surface 14, **14*a***.

We claim:

1. A plastic container comprising a blow molded body having an annular finish, a plastic insert positioned within said finish and means interconnecting the insert with said finish, said insert having internal threads on the inner surface thereof.

2. A plastic container set forth in claim 1 wherein said means interconnect said insert and said finish comprise a spinwelded connection.

3. The plastic container set forth in claim 1 wherein said means interconnecting said insert and said finish comprise a shrink fit of the finish on the insert.

4. The plastic container set forth in claim 1 including knurling between the insert and the finish.

5. The plastic container set forth in claim 1 including splines between said insert and said finish.

6. The plastic container set forth in claim 5 wherein said splines extend horizontally.

7. The plastic container set forth in claim 5 wherein said splines extend vertically.

8. The plastic container set forth in any of claims 1–5 wherein the end of the insert nearest the open end of the finish is displaced axially from the open end of the finish.

9. The plastic container set forth in claim 1 wherein said insert supports a generally axially extending spout.

10. The plastic container set forth in claim 9 wherein said spouts forms an integral part of said insert.

11. A plastic package comprising a blow molded body having an annular finish, a plastic insert positioned within said finish and means interconnecting the insert with said finish, said insert having internal threads on the inner surface thereof, a closure having a peripheral wall with external threads engaging the internal threads of the insert, and means providing a seal between the closure and the finish.

12. The plastic package set forth in claim 11 wherein said means for providing a seal comprises an annular wall intermediate the ends of the closure, said wall having an annular projection extending axially toward the outer surface of the finish of the container and providing a seal.

13. A plastic package set forth in claim 11 wherein said means interconnecting said insert and said finish comprise a spin-welded connection.

14. The plastic package set forth in claim 11 wherein said means interconnecting said insert and said finish comprise a shrink fit of the finish on the insert.

15. The plastic package set forth in claim 11 including knurling between the insert and the finish.

16. The plastic package set forth in claim 11 including splines between said insert and said finish.

17. The plastic package set forth in claim 16 wherein said splines extend horizontally.

18. The plastic package set forth in claim 16 wherein said splines extend vertically.

19. The plastic package set forth in any of claims 11–16 wherein the end of the insert nearest the open end of the finish is displaced axially from the open end of the finish.

20. The plastic package set forth in claim 11 wherein said insert supports a generally axially extending spout.

21. The plastic package set forth in claim 20 wherein said spout forms an integral part of said insert.

* * * * *